US010738689B2

(12) United States Patent
Huber et al.

(10) Patent No.: US 10,738,689 B2
(45) Date of Patent: Aug. 11, 2020

(54) CONNECTING ROD FOR A VARIABLE COMPRESSION INTERNAL COMBUSTION ENGINE

(71) Applicant: ECO Holding 1 GmbH, Marktheidenfeld (DE)

(72) Inventors: David Huber, Aschaffenburg (DE); Dietmar Schulze, Muenzenberg (DE); Michael Seipel, Triefenstein (DE)

(73) Assignee: ECO Holding 1 GmbH, Marktheidenfeld (DE)

( * ) Notice: Subject to any disclaimer, the term of this patent is extended or adjusted under 35 U.S.C. 154(b) by 0 days.

(21) Appl. No.: 16/273,650

(22) Filed: Feb. 12, 2019

(65) Prior Publication Data

US 2019/0301363 A1 Oct. 3, 2019

(30) Foreign Application Priority Data

Mar. 29, 2018 (DE) ..... 10 2018 107 668
Oct. 4, 2018 (DE) ..... 10 2018 124 464

(51) Int. Cl.
*F02B 75/04* (2006.01)

(52) U.S. Cl.
CPC ..... *F02B 75/045* (2013.01)

(58) Field of Classification Search
CPC ..... F02B 75/045; F16C 7/06
See application file for complete search history.

(56) References Cited

U.S. PATENT DOCUMENTS 8,701,715 B1 * 4/2014 Crompton ..... F16K 17/34 138/44

FOREIGN PATENT DOCUMENTS

| | | | | |
|---|---|---|---|---|
| DE | 102012112461 A1 | | 9/2007 | |
| DE | 102010016037 A1 | | 9/2011 | |
| DE | 102012112461 A1 | * | 6/2014 | ..... F02B 75/045 |
| DE | 102015202538 A1 | | 8/2016 | |
| DE | 102015202050 A1 | | 9/2016 | |
| DE | 102016211999 A1 | | 4/2017 | |
| WO | WO2017162425 A1 | | 9/2017 | |

* cited by examiner

*Primary Examiner* — Jacob M Amick
*Assistant Examiner* — Charles Brauch
(74) *Attorney, Agent, or Firm* — Von Rohrscheidt Patents

(57) ABSTRACT

A connecting rod for a variable compression internal combustion engine, the connecting rod including an eccentrical element adjust arrangement for adjusting an effective connecting rod length, wherein an adjustment travel of the eccentrical element adjustment arrangement is adjustable by a switch valve, and wherein a valve housing of the switch valve is axially secured in a borehole of the connecting rod.

17 Claims, 5 Drawing Sheets

(A - A)

(E-E)

(A-A)

(A-A)

CONNECTING ROD FOR A VARIABLE COMPRESSION INTERNAL COMBUSTION ENGINE

RELATED APPLICATIONS

This application claims priority from German patent applications DE 10 2018 107 668.1 filed on Mar. 29, 2018, and DE 10 2018 124 464.9, filed on Oct. 4, 2018, both of which are incorporated in their entirety by this reference.

FIELD OF THE INVENTION

The invention relates to a connecting rod for a variable compression internal combustion engine and to the variable compression internal combustion engine with the connecting rod.

BACKGROUND OF THE INVENTION

In internal combustion engines a high compression ratio has a positive effect upon an efficiency of the internal combustion engine. Compression ratio is typically defined as a ratio of an entire cylinder cavity before compression to a remaining cylinder cavity after compression. In internal combustion engines with external ignition, in particular gasoline engines that have a fixed compression ratio, the compression ratio, however, may only be selected high enough so that a so-called "knocking" of the internal combustion engine is prevented during full load operations. However, for much more prevalent partial load operations of the internal combustion engine, thus for a lower cylinder charge the compression ratio can be selected at a higher level without "knocking" occurring. The important partial load operations of an internal combustion engine can be improved when the compression ratio is variably adjustable. In order to adjust the compression ratio systems with variable connecting rod length are known which actuate an eccentrical element adjustment arrangement of a connecting rod by hydraulic switch valves.

A generic switch valve can be derived e.g. from DE 10 2012 112 461 A1. The switch valve is configured as a cartridge solution. This has the advantage that the switch valve can be checked for leak tightness independently from the connecting rod arrangement into which the switch valve is installed. The switch valve is pressed into the connecting rod body.

BRIEF SUMMARY OF THE INVENTION

Thus, it is an object of the invention to provide an improved cost effective connecting rod for a variable compression internal combustion engine wherein the connecting rod can be reliably produced.

It is another object of the invention to provide a variable compression internal combustion engine with the connecting rod.

The objects are achieved according to an aspect of the invention by the features of the independent claims.

Advantageous embodiments and advantages of the invention can be derived from the dependent claims, the description and the drawing figures.

A connecting rod is proposed for a variable compression internal combustion engine, the connecting rod including an eccentrical element adjustment arrangement for adjusting an effective connective rod length, wherein an adjustment travel of the eccentrical element adjustment arrangement is adjustable by a switch valve. Thus, a valve housing of the switch valve is axially secured in a bore hole of the connecting rod.

The connecting rod includes a connecting rod body and a connecting rod cover arranged at the connecting rod body wherein the connecting rod body and the connecting rod cover envelop a crank bearing eye. A connecting rod bearing eye with the eccentrical element adjustment arrangement is arranged at the opposite end of the connecting rod body. A connecting rod length is a distance of a center axis of the crank bearing eye from a center axis of the connecting rod bearing eye.

It is advantageous for an engineering design implementation of the hydraulic diagram of a connecting rod for a variable compression internal combustion engine to arrange switch valves in the connecting rod body. Typically pressed interconnections are used where valves with a cylindrical external geometry e.g. turn components are pressed into bore holes transversal to a connecting rod center plane. In order to deal with the high loads of the connecting rod the valves have to be positioned so that the bore holes are only exposed to minimum loads which can lead to an oval deformation which however can occur during engine operations. On the one hand side strong deformations lead to leakage when the pressed interconnections are weak and thus reduce the axial retaining force of the pressed interconnection so that the valve can exit from the bore hole in the axial direction. On the other hand side a pressed interconnection can only have an oversize that is permissible based on the structural mechanics of the connecting rod and of the valve due to assembly tensions. Furthermore the valves can rotate axially when the pressed interconnections are weak and do not have enough friction. The orientation of the switch valve in the bore hole can be essential for the function of the valve e.g. when the capture device of the valve is not arranged in the valve axis. This yields a goal conflict for the compressed interconnection configuration: sufficient axial retaining force, position fixation and little leakage versus an impermissibly high assembly tension superimposed by operating tensions.

In order to deal with conflicting requirements very tight tolerance ranges can be selected for the pressed interconnections, however, fabrications cost increases considerably through this measure so that high volume production is not economical anymore.

Therefore the valve housing of the switch valve is provided axially secured in the bore hole of the connecting rod body. Thus, the valve housing cannot get loose and cannot slide or rotate from its predetermined position in the connecting rod body.

This way the upper limit of the pressed interconnection of the valve housing in the connecting rod body can be adapted to the maximum permissible mounting tensions and the lower limit can be moved towards an economical fabrication. The risk of axially moving or rotating the switch valve in the connecting rod during engine operations can be advantageously reduced by the described face side axial safety of the valve housing in the connecting rod.

A simple axial safety can be provided by a weld seam or weld spots between the valve housing and the connecting rod body or connecting rod cover. By the same token a glue or a face coating, e.g. lacquer can be used as a safety.

According to an advantageous embodiment the connecting rod can have one or plural axial bore holes whose protrusions are deformed into one or plural face recesses of the valve housing to provide axial safety for the switch valve. This variant uses a recessed bore hole in the connecting rod and a milled cut out in the valve on the face side. The recessed bore holes provide centering for a forming tool e.g. with a hard ball head which presses the protrusion of the recessed bore holes into the milled cut out of the valves in order to axially secure and fixate the valve against rotation. By the same token a recessed bore hole can be associated with several milled cut outs of different valves. Thus the axial safety can be selected independently from the valve position in the connecting rod. By the same token plural milled cut outs or forming processes can be used.

Recessed bore holes which are arranged in the connecting rod close enough to the bore hole in the connecting rod to receive the switch valve can have a sufficiently thin wall thickness towards the bore hole to form the protrusion so that the material of these protrusions can be displaced towards the bore hole by mechanical pressure. When the valve housing has face recesses at this location the material of the protrusions can be pushed into these recesses. Thus, an interlocking is provided between the connecting rod body or the connecting rod cover and the valve housing. This way the valve housing is secured in the bore hole against axial movement. When the recesses in the valve housing are not circumferential but arranged along a limited angular range the valve housing and thus the switch valve can also be secured against rotation in the bore hole.

According to an advantageous embodiment of the connecting rod the valve housing can have axial bore holes that are recessed wherein protrusions of the recessed bore holes are deformed into one or plural face side recesses of the connecting rod in order to secure the switch valve in the axial direction. The recessed bore holes can also be arranged in the valve and the face side cut outs can be arranged in the connecting rod body. This facilitates axially securing the valve housing in the bore hole of the connecting rod when the material of the protrusions is displaced.

According to an advantageous embodiment of the connecting rod the protrusions of the recessed bore holes can be pressed into the recesses by a forming tool. The material of the protrusions can be pressed into the recesses by a mechanical pressure that can be generated e.g. by a forming tool. Thus, the desired teething between the connecting rod body and the connecting rod cover and the valve housing can be achieved in a suitable manner.

According to an advantageously embodiment of the connecting rod balls can be pressed in to the recessed bore holes, which presses the protrusions into the recesses. Pressing a ball into the recessed bore hole is one variant of this technical solution. When pressing the ball into the recessed bore hole the protrusion is deformed far enough so that an axial safety and a rotation safety is provided, but the ball is also prevented from disengaging. Thus, the desired teething can be achieved between the connecting rod body or the connecting rod cover or the valve housing in a suitable manner. In a similar manner also cone shaped or frustum shaped elements can be pressed into the recessed bore holes in order to achieve the desired effect.

According to an advantageous embodiment of the connecting rod the recesses can be provided as a bevel that is circumferentially arranged on an outer edge of the valve housing. A simple embodiment of the recesses of the valve housing can be configured in a form of a bevel that is circumferentially arranged on an outer edge of the valve housing. This helps to achieve an axial safety of the valve housing in the bore hole of the connecting rod. When the material of the protrusions is pressed with a suitable pressure into the bevel and against the valve housing, then a safety against rotation of the valve housing can be achieved in the bore hole.

According to an advantageous embodiment of the connecting rod, the valve housing can have an axial protrusion at least at one face, wherein the protrusion is fixed with a retaining ring in order to secure the switch valve axially. Another variant of the face side axial safety is used for protruding valves that are fixed by retaining rings with respect to their axial position. Also DIN-standard components can be used as retaining rings. The retaining ring can be fixed by a fit, a weld, in a groove, a thread or a similar fixing option at the valve.

According to an advantageous embodiment of the connecting rod, the valve housing can have an axial shoulder on a first face and an axial protrusion on a second face, wherein the protrusion is fixed by a retaining ring in order to axially secure the switch valve. Thus, the valve can also be alternatively provided with an axial shoulder at a face, wherein the axial shoulder contacts the connecting rod body or the connecting rod cover and a retaining ring at the axial protrusion of the second face which functions as a reaction bearing on the other face of the connecting rod in order to fix the valve housing. The retaining ring can be fixed at the valve by a fit, by a weld, in a groove, by a thread or a similar fixing option at the valve.

According to an advantageous embodiment of the connecting rod, the retaining ring can be attached at the protrusion by a press fit, by a welded joint or by a thread. The retaining ring can be advantageously fixed at the valve by a fit, a weld, in a groove, a thread or a similar fixing option.

According to an advantageous embodiment of the connecting rod, the retaining ring can include at least one rotation safety. In order to provide an additional rotation safety, the retaining ring can be secured against rotation, e.g., as a ring with retaining lobes that interlock in a counterpiece or interlock on both sides.

According to an advantageous embodiment of the connecting rod, the rotation safety can include at least one lobe that protrudes radially outward from the retaining ring and that is fixed at the connecting rod, in particular at the connecting rod cover. In particular the lobe can be bonded together with the connecting rod, e.g., welded together.

According to an advantageous embodiment of the connecting rod, the lobe can engage a recess of the connecting rod. Advantageously the lobe can interlock in a recess of the connecting rod. Thus, it can be advantageously provided that the retaining ring can be disengaged again, e.g., when the switch valve is to be replaced.

According to an advantageous embodiment of the connecting rod, the valve housing can have an axial protrusion at least on one face, wherein the protrusion is deformed after mounting the valve housing in order to axially secure the switch valve. Thus, an axial safety can be facilitated without additional components. Advantageously the valve housing is heat-treated in the portion of the protrusion before the deforming process.

According to an advantageous embodiment of the connecting rod, at least one center punch can be provided on at least one face of the valve housing in order to provide axial safety for the switch valve which displaces material of the valve housing into a borehole gap between the valve housing and the connecting rod. Through material deformation, the switch valve can be secured against an axial movement and against rotation. This can be achieved on the one hand side by putting a center punch into the face of the valve housing wherein the center punch deforms material in a radially outward direction towards the connecting rod body or connecting rod cover.

According to an advantageous embodiment of the connecting rod, at least one center punch can be arranged on at least one face of the connecting rod in order to provide axial safety for the switch valve so that material of the connecting rod is displaced into the borehole gap between the valve housing and the connecting rod. Alternatively the axial safety of the switch valve can also be provided by putting a center punch into the face of the connecting rod, wherein material is deformed in a radially inward direction towards the valve housing.

According to an advantageous embodiment of the connecting rod, at least one safety element can be arranged in the borehole gap between the valve housing and the connecting rod in order to provide axial safety for the switch valve. Using a retaining element, e.g., a fitted key, a cone, a wedge, is another option wherein the retaining element can be configured as a DIN-standard component and is driven on a face side between the valve and the borehole into the borehole gap. The retaining element can be additionally welded, glued or fixed in a similar manner. A combination of using a retaining ring and providing axial safety with the retaining element is providing axial safety by retaining pins. Thus, at least one pin can be pressed, welded, glued or joined otherwise into the borehole gap or a pocket between the connecting rod body and the valve housing on each face of the valve housing.

According to another aspect of the invention, an internal combustion engine with at least one connecting rod is proposed. Thus, a connecting of the type described supra can be advantageously used in order to implement an eccentrical element adjustment arrangement and an advantageous combustion process in order to reduce fuel burn of the internal combustion engine.

BRIEF DESCRIPTION OF THE DRAWINGS

Further advantages can be derived from the subsequent description of an advantageous embodiment with reference to drawing figures, wherein.

DETAILED DESCRIPTION OF THE INVENTION

Figure 1:
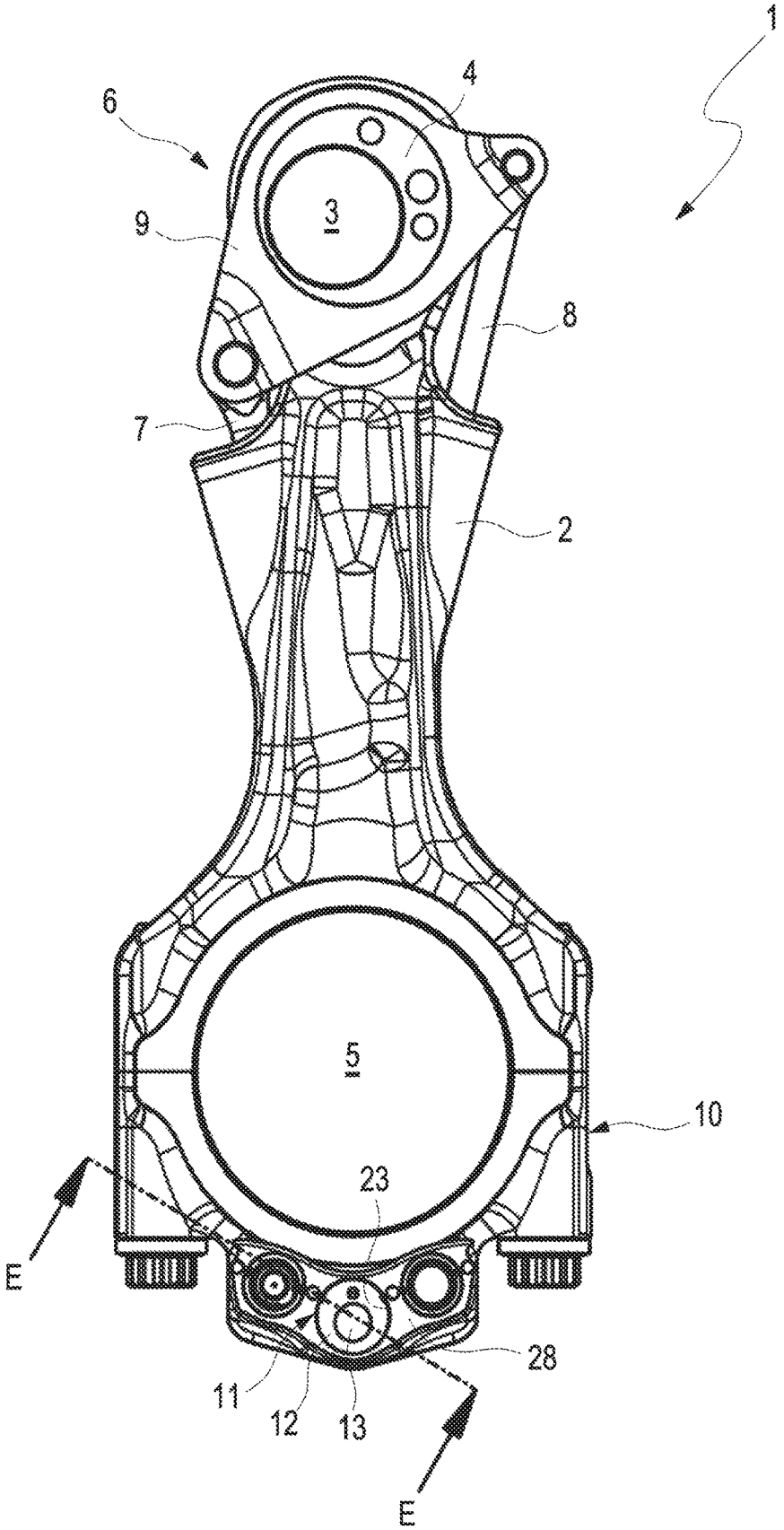
FIG. 1 illustrates a side view of a connecting rod according to the invention in a first position with a drawn-in sectional plane E-E.

In the drawing figures identical or like components are designated with identical reference numerals. The drawing figures merely illustrate exemplary embodiments and do not limit the spirit and scope of the invention.

Figure 2:
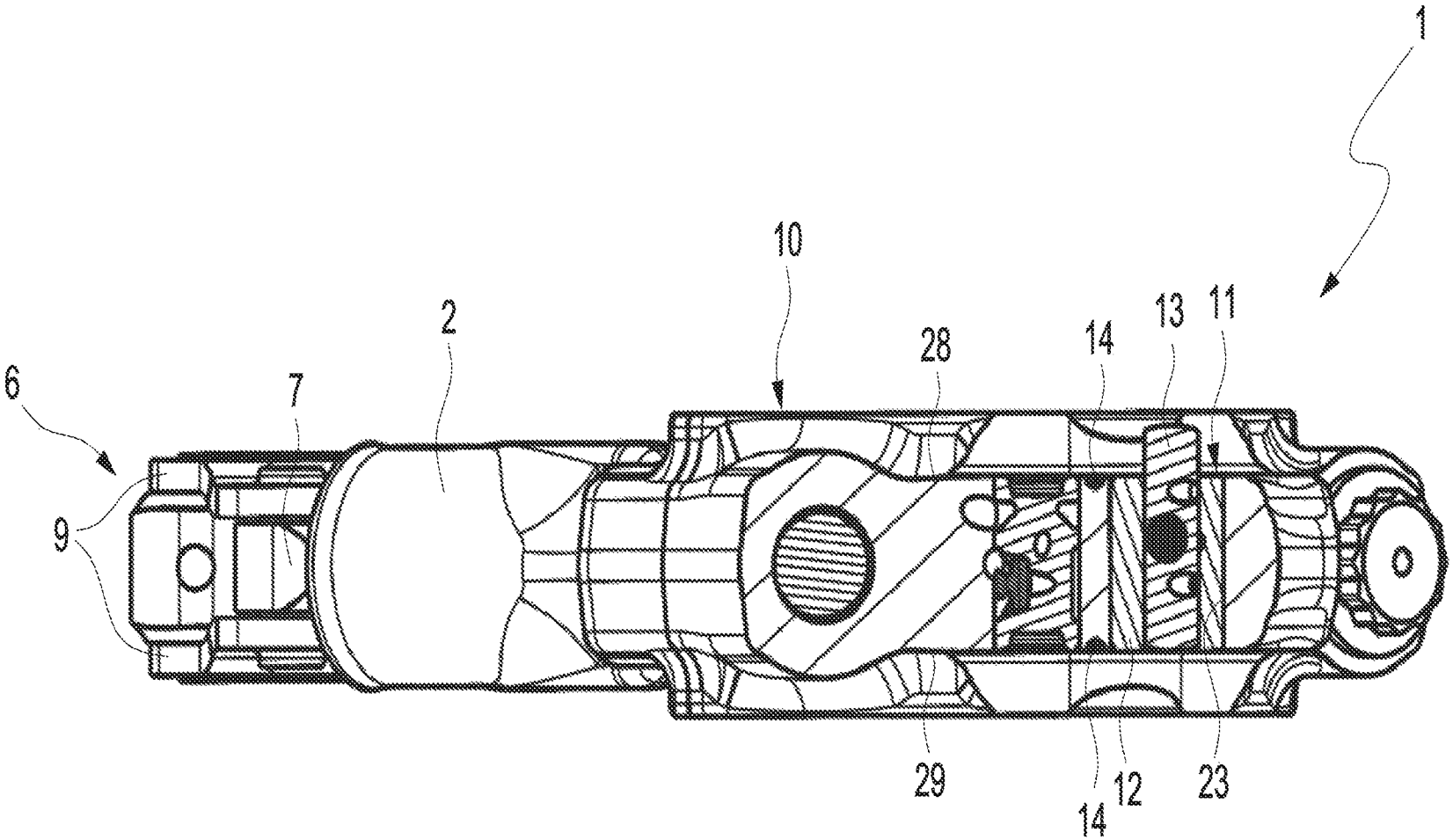
FIG. 2 illustrates a blown-up sectional view of the connecting rod in the sectional plane E-E according to FIG. 1.

FIGS. 1 and 2 illustrate a connecting rod 1 according to the invention for a variable compression internal combustion engine wherein FIG. 1 illustrates a side view of the connecting rod 1 and FIG. 2 illustrates a blown-up sectional view through the connecting rod 10. The connecting rod 1 includes a connecting rod cover 2 and an adjustable eccentrical element adjustment arrangement 6 with an eccentrical element 4 that is arranged at least in sections in a connecting rod bearing eye 3. A crank-bearing eye 5 is arranged at the opposite end of the connecting rod body 2 wherein the crank-bearing eye is closed by the connecting rod cover 10. The eccentrical element adjustment arrangement 6 is used for adjusting an effective connecting rod length. The connecting rod length is a distance of a center axis of the crank-bearing eye 5 from a center axis of the connecting rod bearing eye 3.

A rotation of the adjustable eccentrical element adjustment arrangement 6 is initiated by an impact of mass and load forces of the internal combustion engine wherein the mass and load forces impact the eccentrical element adjustment arrangement 6 during an operating stroke of the internal combustion engine. Effective directions of forces that impact the eccentrical element adjustment arrangement 6 change continuously during an operating stroke. The rotating movement or adjustment movement is supported by pistons that are integrated in the connecting rod 1 and that are loaded with a hydraulic fluid, in particular motor oil. The pistons thus prevent a resetting of the eccentrical element adjustment arrangement 6 due to varying force effective directions of forces that impact the eccentrical element adjustment arrangement 6.

The pistons are operatively connected on both sides with a lever 9 of the eccentrical element adjustment arrangement 6 by eccentrical element rods 7, 8. The pistons are movably arranged in hydraulic chambers and loaded with hydraulic fluid through non-illustrated hydraulic fluid conduits through non-visible check valves. The check valves thus prevent a flowback of the hydraulic fluid from the hydraulic chambers back into the hydraulic fluid conduits and facilitate a pulling of hydraulic fluid into the hydraulic chambers. The hydraulic fluid conduits that are connected with the hydraulic chambers cooperate with a switch valve 11 at least partially.

The switch valve 11 which represents an enlarged detail in the sectional plane E-E includes a capture element 13 that is arranged in a valve housing 12 and which is moveable in an axial direction into a first switching position or a second switching position and interlockable by a spring loaded interlocking element in the first switching position or the second switching position.

In order to implement the hydraulic diagram of the connecting rod 1 in an engineering design, it is necessary to introduce a switch valve 1 into the connecting rod body 2 or the connecting rod cover 10. A viable option is using pressed interconnections where switch valves 11 with a circular outer geometry (turned components) are pressed into boreholes 23 transversal to a center plane of the connecting rod. In order to bear the high loads of the connecting rod 1 the switch valves 11 have to be positioned so that the boreholes 23 are exposed to minimum loads from engine operations that can cause an oval deformation. On the one hand side strong deformations lead to leakage of weak pressed interconnections and reduce the axial retaining force of the pressed interconnection so that the switch valve 11 can move axially out of the borehole 23. On the other hand side, the pressed interconnection can only be configured with an oversize that is permitted by the structural mechanics of the connecting rod 1 and of the switch valve 11 due to tensions caused by an assembly process. Additionally, the switch valves 11 can rotate axially when weak pressed interconnections are used that have an amount of friction that is too low. An orientation of the switch valve 11 in the borehole 23 can be important for example when the capture element is introduced into the switch valve remote from an axis. This causes a conflict in the design of the pressed interconnection, namely between sufficient axial retaining force, position fixing and low leakage versus an impermissibly high assembly tension that is superimposed by operating tensions.

In order to satisfy these conflicting requirements, very tight tolerance ranges can be selected for the pressed interconnections. However, fabrication cost increases significantly for these measures which renders them less attractive for applications with high volume production.

According to the invention, the valve housing 12 of the switch valve 11 is axially secured in a borehole 23 of the connecting rod 1.

Figure 3:
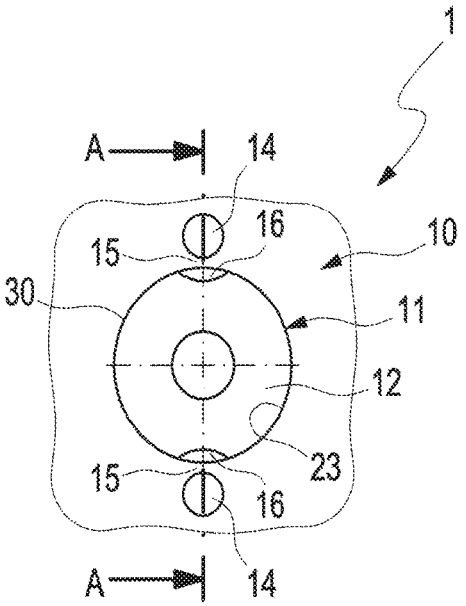
FIG. 3 illustrates a top view of a switch valve with recessed boreholes that is installed into the connecting rod according to FIG. 1 according to an embodiment of the invention with an indicated sectional plane A-A.
Figure 4:
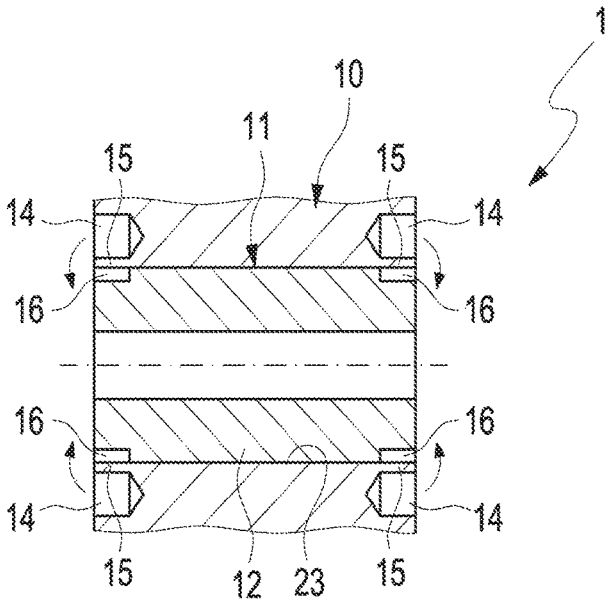
FIG. 4 illustrates a longitudinal sectional view through the switch valve in the sectional plane A-A according to FIG. 3.

As evident in particular from the top view in FIG. 3 and the corresponding sectional view in FIG. 4, the connecting rod 1 or the connecting rod cover 10 can have one or plural axial recessed boreholes 14 according to an embodiment wherein protrusions 15 of the axial recessed boreholes 14 that are oriented towards the valve housing 12 are deformed into one or plural face recesses 16 of the valve housing 12 to provide axial safety for the switch valve 11. Alternatively, it is also possible to provide the axial recessed boreholes 14 in the valve housing 12 and to provide the recesses 16 in the connecting rod.

The protrusions 15 of the recessed boreholes 14 are pressed into the recesses 16 using a forming tool. Thus, the recessed boreholes 14 are used for centering the forming tool, e.g., for a hard ballhead which deforms the protrusions 15 and presses them into the recesses 16, so that the valve housing 12 is secured axially in the borehole of the connecting rod 1 and secured against rotation.

A non-illustrated embodiment provides that balls are pressed into the recessed boreholes 14 of the connecting rod 1 so that the protrusions 15 are pressed into the recesses 16.

In another non-illustrated embodiment, the recesses 16 can be provided as a circumferential bevel on an outer edge 30 of the valve housing 12. Also this configuration provides an axial safety and a rotation safety of the valve housing 12 in the connecting rod 1 when the protrusions 15 of the recessed boreholes 14 are pressed firmly enough.

Figure 5:
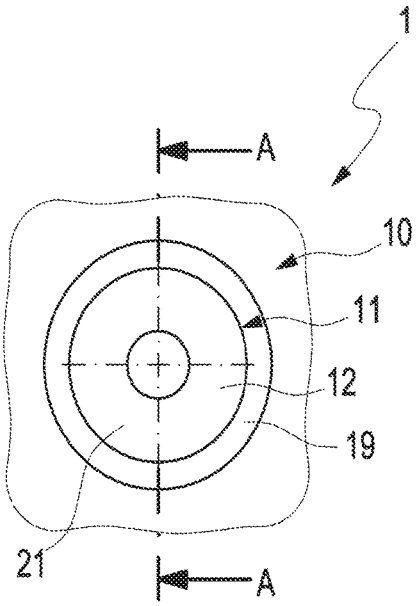
FIG. 5 illustrates a top view of a switch valve that is installed into the connecting rod according to FIG. 1 and includes a shoulder and a retaining ring according to another embodiment of the invention with a drawn-in sectional plane A-A.
Figure 6:
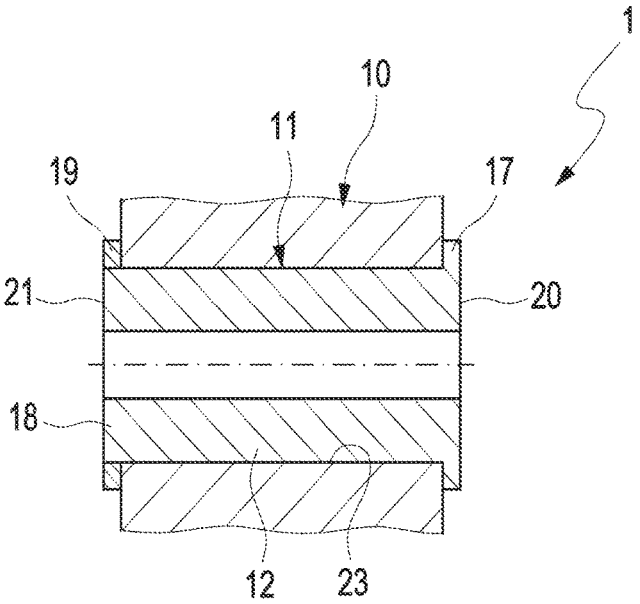
FIG. 6 illustrates a longitudinal sectional view through the switch valve in the sectional plane A-A according to FIG. 5.

According to another embodiment which is illustrated in a topview in FIG. 5 and illustrated in the respective sectional view in FIG. 6, the switch valve 11 can have an axial stop configured as a shoulder 17 on a first face 20, wherein the shoulder contacts the connecting rod 1 and contacts the connecting rod cover 10 in the embodiment illustrated in FIGS. 5 and 6. The valve housing 12 has an axial protrusion 18 on a second face 21 wherein the axial protrusion 18 is fixed by a retaining ring 19 in order to axially secure the switch valve 11.

The retaining ring 19 can be pressed onto the protrusion 18, welded down, or attached by a thread. Other attachment options are also conceivable according to the invention. According to a non-illustrated embodiment, the retaining ring 19 can engage a groove of the valve housing 12 and can be fixed therein.

In another non-illustrated embodiment, the valve housing 12 can also be configured without the shoulder 17. When the retaining ring 19 that is arranged at the protrusion 18 is fixed at the valve housing 12 and at the connecting rod body 2 or the connecting rod cover 10, e.g., welded down, this also facilitates an axial safety and a rotation safety of the valve housing 12 in the connecting rod 1.

According to another non-illustrated embodiment, the protrusion 18 of the valve housing 12 can be deformed in order to provide an axial safety for the switch valve 11. Thus, the valve housing 12 is heat treated in the portion of the protrusion 18 after assembly in the connecting rod 1 in order to be able to perform the deforming process of the protrusion 18 at the second face 21.

The heat treatment is performed, e.g., by annealing the material, e.g., by a laser process or by inductive heating. A penetration depth of the heat treatment can be advantageously selected so that only the protrusion 18 is heat treated. Deforming the protrusion 18 is advantageously performed by a flanging method.

Figure 7:
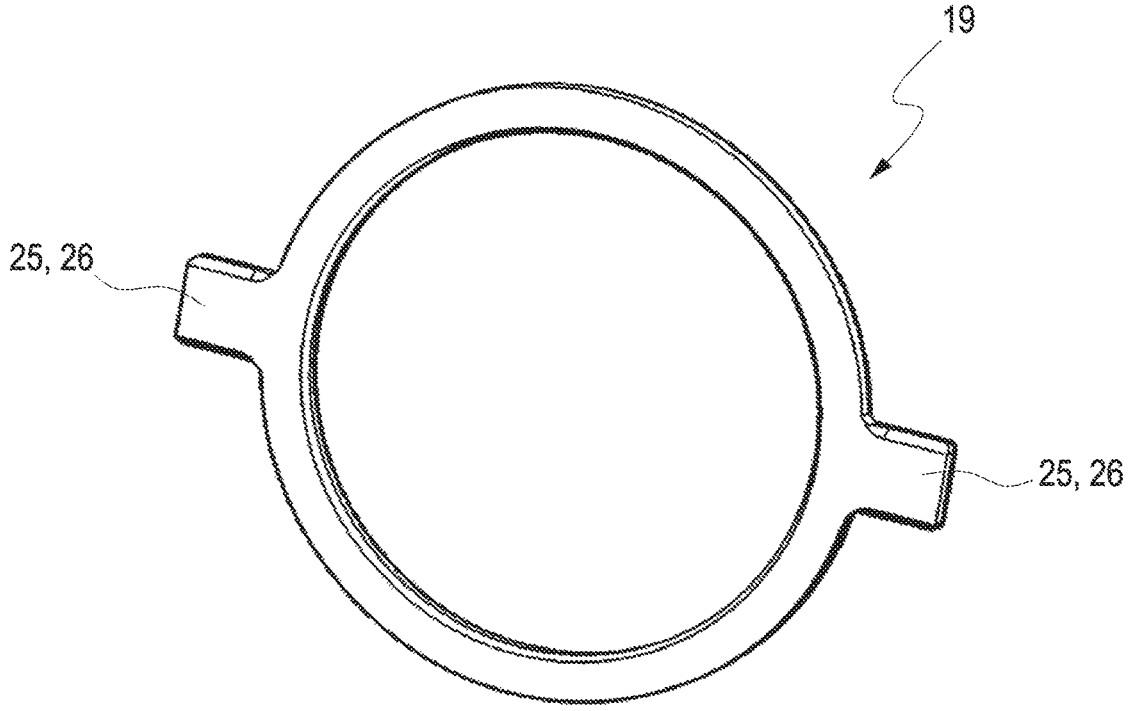
FIG. 7 illustrates an isometric view of a retaining ring for a switch valve according to another embodiment of the invention.

As illustrated in the isometric view of FIG. 7, the retaining ring 19 can include an additional rotation safety 26. For example, retaining lobes 25 are conceivable that engage corresponding recesses in the connecting rod 1. The rotation safety 26 can include at least one lobe 25 that protrudes in a radial direction from the retaining ring 19 outward and that is fixed at the connecting rod 1, in particular at the connecting rod cover 10. The embodiment in FIG. 7 includes two opposite radially outward protruding lobes 25. The lobes 25 can engage corresponding recesses of the connecting rod 1 and can thus provide an effective rotation safety 26.

Figure 8:
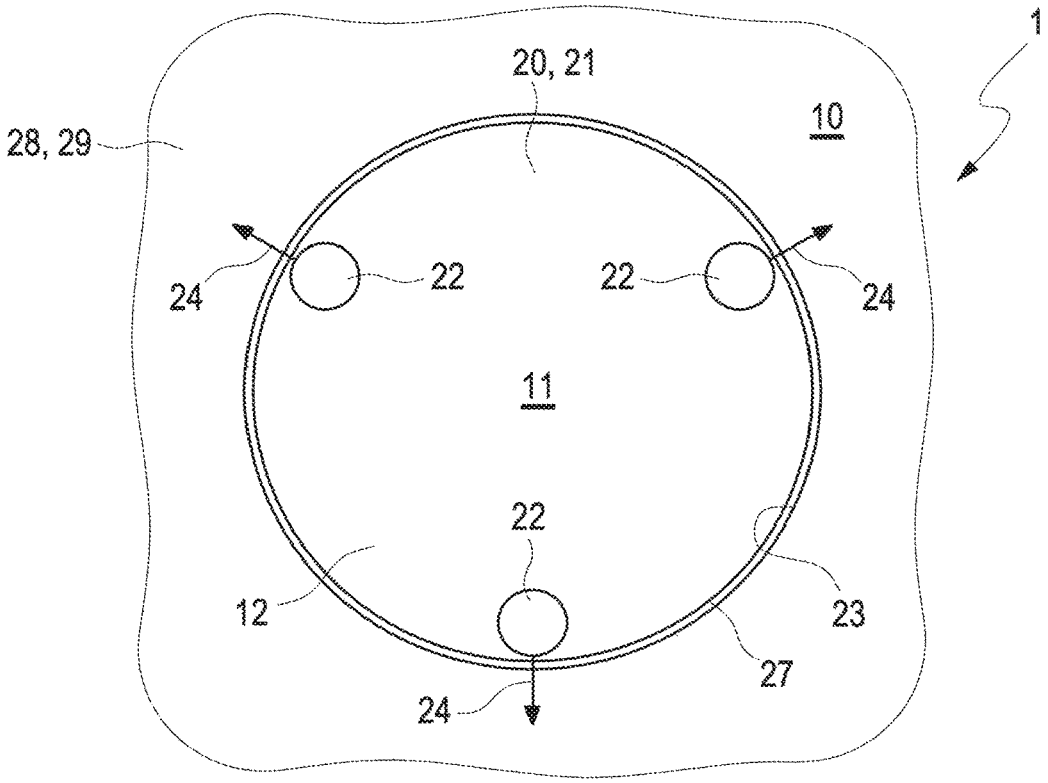
FIG. 8 illustrates a schematic top view of a switch valve with center punches in the valve housing according to another embodiment of the invention that is installed in the connecting rod according to FIG. 1.

FIG. 8 illustrates a schematic top view of a switch valve 11 with center punches 22 on a face 20, 21 of the valve housing 12 that is installed into the connecting rod 1 according to FIG. 1 according another embodiment of the invention. Through the center punches 22 material of the valve housing 12 is displaced into a borehole gap 27 between the valve housing 12 and the connecting rod 1 by a forming tool in order to provide axial safety for the switch valve 11. The arrow directions 24 in FIG. 8 illustrate the deforming directions of the displaced material. The material is displaced away from the center punch 22 in a radially outward direction into the borehole gap 27 so that the valve housing 12 is effectively fixed in the borehole gap of the connecting rod cover 10 and thus axially secured and secured against rotation. The faces 20, 21 of the valve housing 12 terminate with the faces 28, 29 of the connecting rod cover 10.

Figure 9:
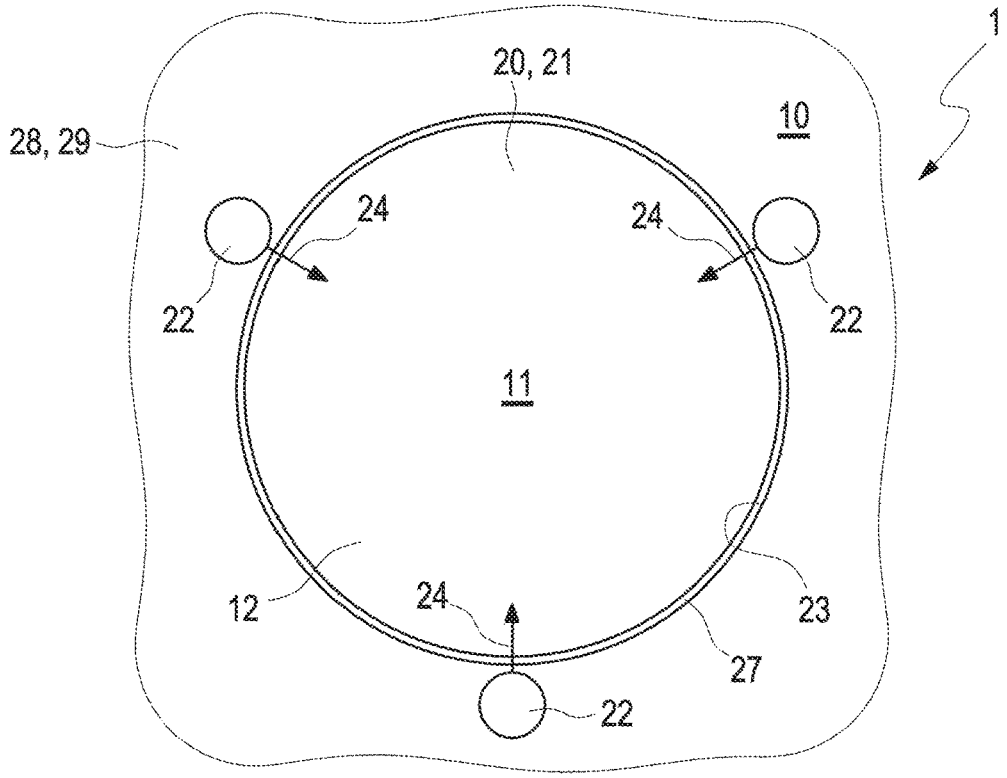
FIG. 9 illustrates a schematic top view of a switch valve with center punches in the connecting rod cover according to another embodiment of the invention installed in the connecting rod according to FIG. 1.

FIG. 9 illustrates an alternative embodiment of a switch valve 11 with center punches 22 in the connecting rod cover 10. In this case the material of the connecting rod cover 10 is displaced in a radially inward direction into the borehole gap 27 according to the illustrated deformation direction 24 in order to provide axial safety for the switch valve 11.

As variants for axial safety and/or rotation safety, other embodiments are conceivable. A simple axial safety can also be provided by a weld seam or by spot welds. By the same token, a glue or a face coating (lacquer) can be used as a safety against a dropout or rotation of the valve housing 12 in the connecting rod 1.

Another option is using a safety element 31, e.g., a fit key, a cone, or a wedge, which can be configured, e.g., as a DIN-standard component and that can be driven on a face side between the valve housing 12 and the borehole. The standard component can be additionally welded, glued or joined in a similar manner.

Figure 10:
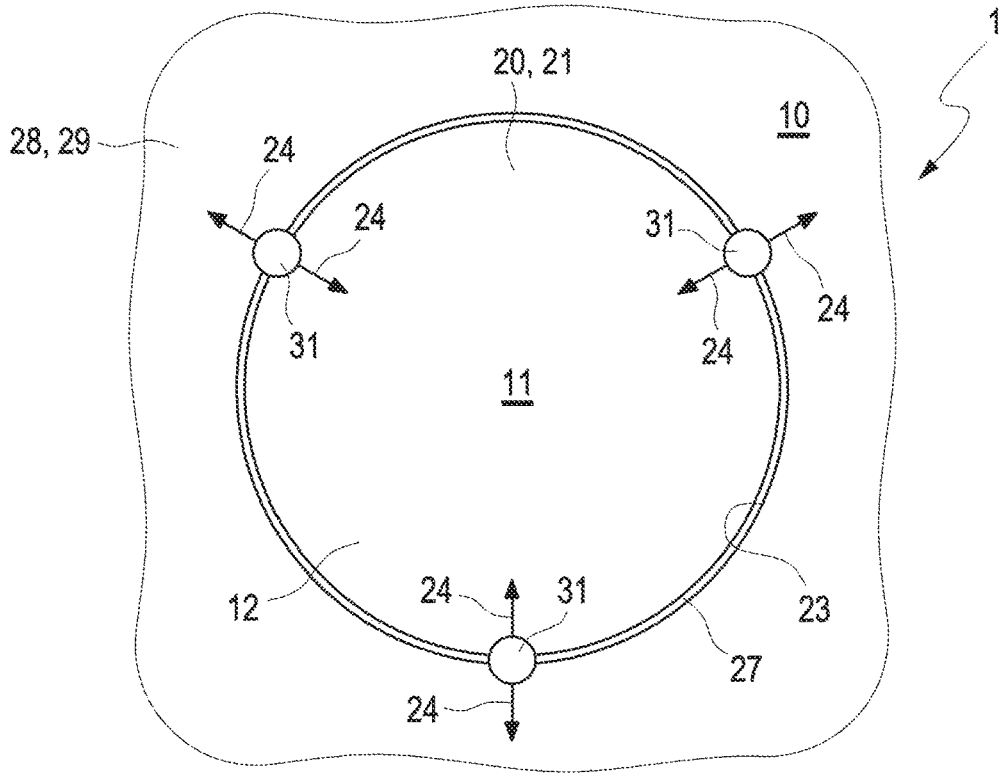
FIG. 10 illustrates a schematic top view of a switch valve with safety elements according to another embodiment of the invention installed in the connecting rod according to FIG. 1.

FIG. 10 illustrates a switch valve 11 with safety elements 31 of this type that is installed in a connecting rod 1 according to FIG. 1 according to another embodiment of the invention in a schematic topview. In this embodiment at least one safety element, in FIG. 10 three safety elements 31, are arranged in the borehole gap 27 between the valve housing 12 and the connecting rod 1 in order to provide axial safety of the switch valve 11.

A combination of using a retaining ring 19 and an axial safety through the safety element 31 is the axial safety by pins. Thus, at least one pin is pressed, welded, glued or joined in another way per side in a pocket in the connecting rod body or the connecting rod cover and the valve housing 12.

What is claimed is:

1. A connecting rod for a variable compression internal combustion engine, the connecting rod comprising:

an eccentrical element adjust arrangement or adjusting an effective connecting rod length, and at least one recessed axial borehole whose protrusion is deformed into at least one face recess of the valve housing so that the switch valve is secured axially, wherein an adjustment travel of the eccentrical element adjustment arrangement is adjustable by a switch valve, and wherein a valve housing of the switch valve is axially secured in a borehole of the connecting rod.

2. A connecting rod for a variable compression internal combustion engine, the connecting rod comprising:

an eccentrical element adjust arrangement or adjusting an effective connecting rod length, wherein an adjustment travel of the eccentrical element adjustment arrangement is adjustable by a switch valve, and wherein a valve housing of the switch valve is axially secured in a borehole of the connecting rod, wherein the valve housing includes recessed axial boreholes wherein protrusions of the recessed axial boreholes are deformed into at least one face recess of the connecting rod in order to secure the switch valve axially.

3. The connecting rod according to claim 1, wherein the protrusion of the at least one recessed axial borehole is pressed into the at least one face recess by a forming tool.

4. The connecting rod according to claim 1, wherein balls are pressed into the at least one recessed borehole so that the protrusions are pressed into the at least one face recess.

5. The connecting rod according to claim 1, wherein the at least one face recess is configured as a circumferential bevel on an outer edge of the valve housing.

6. The connecting rod according to claim 1, wherein the valve housing includes an axial protrusion at least on one face, and wherein the axial protrusion is fixed by a retaining ring so that the switch valve is secured axially.

7. The connecting rod according to claim 1, wherein the valve housing includes an axial shoulder on a first ace and an axial protrusion on a second face, and wherein the axial protrusion is fixed by a retaining ring so that the switch valve is secured axially.

8. The connecting rod according to claim 6, wherein the retaining ring is attached at the protrusion by a press fit, a weld or a thread.

9. The connecting rod according to claim 6, wherein the retaining ring includes at least one rotation safety.

10. The connecting rod according to claim 9, wherein the at least one rotation safety includes at least one lobe that protrudes radially outward from the retaining ring, and wherein the at least one lobe is fixed at the connecting rod or at a connecting rod cover.

11. The connecting rod according to claim 10, wherein the at least one lobe engages a recess of the connecting rod.

12. The connecting rod according to claim 1, wherein the valve housing includes an axial protrusion on at least one face, and wherein the axial protrusion is deformed with the valve housing assembled in the connecting rod so the switch valve is axially secured.

13. The connecting rod according to claim 12, wherein the valve housing is heat treated in a portion of the axial protrusion.

14. The connecting rod according to claim 1, wherein at least one center punch is arranged on at least one face of the valve housing, and wherein material of the valve housing is displaced by the at least one center punch into a borehole gap between the valve housing and the connecting rod so that the switch valve is secured axially.

15. The connecting rod according to claim 1, wherein at least one center punch is arranged on at least one face of the connecting rod, and wherein material of the connecting rod is displaced by the at least one center punch into a borehole gap between the valve housing and the connecting rod so that the switch valve is secured axially.

16. The connecting rod according to claim 1, wherein at least one safety element is arranged in a borehole gap between the valve housing and the connecting rod so that the switch valve is secured axially.

17. An internal combustion engine, comprising: at least one connecting rod according to claim 1.

* * * * *